US008344887B2

(12) United States Patent
Czapla

(10) Patent No.: US 8,344,887 B2
(45) Date of Patent: Jan. 1, 2013

(54) SYSTEM, CONTROL STATION, AND METHOD FOR CONTROLLING CIRCULATION OF MEDIA MATERIALS

(75) Inventor: Kenneth R. Czapla, Danville, IN (US)

(73) Assignee: Central Technology, Inc., Avon, IN (US)

( * ) Notice: Subject to any disclaimer, the term of this patent is extended or adjusted under 35 U.S.C. 154(b) by 377 days.

(21) Appl. No.: 12/833,362

(22) Filed: Jul. 9, 2010

(65) Prior Publication Data

US 2012/0007739 A1 Jan. 12, 2012

(51) Int. Cl.
*G08B 13/14* (2006.01)

(52) U.S. Cl. ..... 340/572.1; 340/568.1; 340/539.1

(58) Field of Classification Search .... 340/572.1–572.9, 340/568.1, 539.1, 5.74, 5.2, 5.1
See application file for complete search history.

(56) References Cited

U.S. PATENT DOCUMENTS 5,288,980 A 2/1994 Patel et al.
5,502,766 A * 3/1996 Boebert et al. ..... 713/193
7,289,026 B2 * 10/2007 Hackstadt et al. ..... 340/572.1
7,380,711 B2 * 6/2008 Simon et al. ..... 235/383
7,461,784 B2 12/2008 Robkin et al.

OTHER PUBLICATIONS

Integrated Technology Group; Apex Xpress Check; 8 pp; published on the World Wide Web prior to Jan. 1, 2010.
3M; Integrated Disc Media Unlocker; 11 pp.; published on the World Wide Web prior to Jan. 1, 2010.
Checkpoint; DiscMate; 2 pp.; published prior to Jan. 1, 2008.
Techlogic; Media Passport; 2 pp.; published prior to Sep. 1, 2009.
Integrated Technology; Secure Detacher; 1 p.; published on the World Wide Web prior to Jan. 1, 2010.

* cited by examiner

*Primary Examiner* — Daniel Previl
(74) *Attorney, Agent, or Firm* — Liell & McNeil

(57) ABSTRACT

A system for controlling circulation of media materials from a library includes a control system and a circulation control station having a housing defining a receptacle which is configured to receive a packaged unit of securable media therein. The circulation control station includes an electronic security control mechanism and a mechanical security control mechanism, each mounted to the housing. The electronic security control mechanism may include an RFID reader/writer, and the mechanical security control mechanism may include a magnet and an actuator. The control system is configured to release a packaged unit of securable media to circulation by disabling an electronic security device and a magnetic security device of a packaged unit of securable media resident within the receptacle and executing a media checkout procedure.

21 Claims, 8 Drawing Sheets

SYSTEM, CONTROL STATION, AND METHOD FOR CONTROLLING CIRCULATION OF MEDIA MATERIALS

TECHNICAL FIELD

The present disclosure relates generally to security systems and strategies for controlling the circulation of media materials, and relates more particularly to releasing media materials to circulation by disabling electronic and magnetic security devices of a packaged unit of media in a one-step process.

BACKGROUND

A variety of different systems and strategies for monitoring and controlling the circulation of articles from libraries and other lending institutions have been known for many years. In decades past, lending institutions typically maintained a card bank or the like in which a circulation status of each article of media in the library collection was recorded, and manually updated as articles were checked out from and returned to the library. Such strategies worked fairly well for tracking the circulation of traditional media materials such as books. Recent years have seen an enormous increase in the number of electronic and magnetic media articles such as CD's, DVD's, and audio and videotapes in library collections. While card banks can be and have been used for any type of media, they provide essentially no security against unauthorized checkout or theft of media materials, which is particularly problematic in the case of relatively expensive and highly sought after electronic and magnetic media.

In an attempt to better manage control over the circulation of media materials, libraries began equipping certain articles with security devices some time ago. As security technology has evolved, and become more affordable, some or all of the articles in many library collections have been equipped with individual security devices. Radiofrequency ("RF") tags and the like are now commonly coupled with media in library collections. If a person attempts to exit the library with a media article whose security tag is "armed" detection devices typically placed at library exits may activate an alarm.

In the case of certain media articles, an additional security mechanism in the form of a lockable case may be provided. The packaged unit of the case and media storage component such as a computer readable disk may be equipped with a mechanical lock for the case, and also with one or more electronic security features. The electronic security features must be disabled for the media unit to pass through the security detector without tripping an alarm, and the locked case provides a disincentive to even attempting to do so. The locked case also provides an impediment to fooling the library by switching the media article such as a disk within one case for a different media article.

The implementation of such advanced security and monitoring strategies has made checking out media materials somewhat more complicated. In the case of locked, packaged units of media, a patron or library staff member typically has to perform conventional checkout procedures, disable the electronic security device(s) and unlock the case. Various case unlocking mechanisms are commercially available. These mechanisms may be integrated with a self-checkout station in an attempt to minimize the need for staff supervision and/or intervention.

One known type of case unlocking mechanism utilizes a magnet configured to unlock a magnetic security device of a case component for an article of media. The magnet is positioned in a housing, and retractable pins or the like prevent access, so that the magnet may only be used for case unlocking if an electronic authorization is generated to cause the pins to retract. A patron will typically initiate a self-checkout procedure at a computer terminal, place the media unit of interest on a scanning pad to identify it and disable an electronic security device, then position the media unit to interact with the magnet if so authorized. While this type of system has been adopted in some libraries, it generally requires a relatively lengthy checkout procedure for each individual media unit. Moreover, once the magnet unlocking mechanism is made available for use, such as by retracting the pins, no restriction on what media unit can be unlocked exists. In other words, a patron could checkout one packaged media unit, but then use the magnetic unlocking mechanism to unlock a different unit. This creates opportunities for fraudulent checkout and theft.

Other types of case unlockers use a movable magnet rather than retractable pins or the like. The magnet is movable within a housing when so authorized by a computer handling checkout procedures. Like the foregoing example, no restriction on the particular media unit to be unlocked exists, and the checkout process may be onerous, particularly where multiple units of media are to be processed for releasing to circulation.

SUMMARY OF THE DISCLOSURE

In one aspect, a method of controlling circulation of media materials includes electronically reading media identification data from a packaged unit of securable media resident within a receptacle of a circulation control station, and transmitting a release request from the circulation control station responsive to the media identification data. The method further includes receiving a release authorization transmitted to the circulation control station responsive to the release request, and establishing a magnetic communication link between the packaged unit and a mechanical security control mechanism, responsive to the release authorization. The method still further includes releasing the packaged unit to circulation at least in part by disabling each of an electronic security device and a magnetic security device of the packaged unit while resident within the receptacle.

In another aspect, a circulation control station for securable media materials includes a housing defining a receptacle including a first, open end and a second, blind end, the receptacle being configured to receive a packaged unit of securable media therein. The control station further includes an electronic security control mechanism mounted to the housing and including a reading mode for reading media identification data from the packaged unit of securable media, and an electronic security disabling mode which includes a write mode. The control station further includes a mechanical security control mechanism mounted to the housing and including a magnet and an actuator, and further having a rest mode, and a magnetic security disabling mode. The control station further includes a computer coupled with each of the security control mechanisms. The computer is configured to output a release request responsive to the media identification data, and to receive a release authorization generated in response to the release request. The computer is further configured to release the packaged unit to circulation at least in part by switching the electronic security control mechanism to the electronic security disabling mode and switching the mechanical security control mechanism to the magnetic security disabling mode, responsive to the release authorization.

In still another aspect, a system for controlling circulation of media materials from a library includes a control system having at least one computer, and a circulation control station. The circulation control station includes a housing defining a receptacle configured to receive a packaged unit of securable media therein, an electronic security control mechanism mounted to the housing, and a mechanical security control mechanism also mounted to the housing. The electronic security control mechanism includes a reading mode for reading media identification data from a packaged unit of securable media, and an electronic security disabling mode which includes a write mode. The mechanical security control mechanism includes a rest mode and a magnetic security disabling mode. The circulation control station further includes a first configuration at which the electronic security control mechanism is in the reading mode and the mechanical security control mechanism is in the rest mode, and a second configuration at which the electronic security control mechanism is in the reading mode and the mechanical security control mechanism is in the rest mode, and a second configuration at which the electronic security control mechanism is in the electronic security disabling mode and the mechanical security control mechanism is in the magnetic security disabling mode. The control system is coupled with each of the security control mechanisms and configured to transmit a release request to a server responsive to the media identification data, and further configured to receive a release authorization transmitted from the server in response to the release request. The control system is further configured to release a packaged unit of securable media resident within the receptacle to circulation at least in part by switching the circulation control station from the first configuration to the second configuration, responsive to the release authorization.

DETAILED DESCRIPTION

Figure 1:
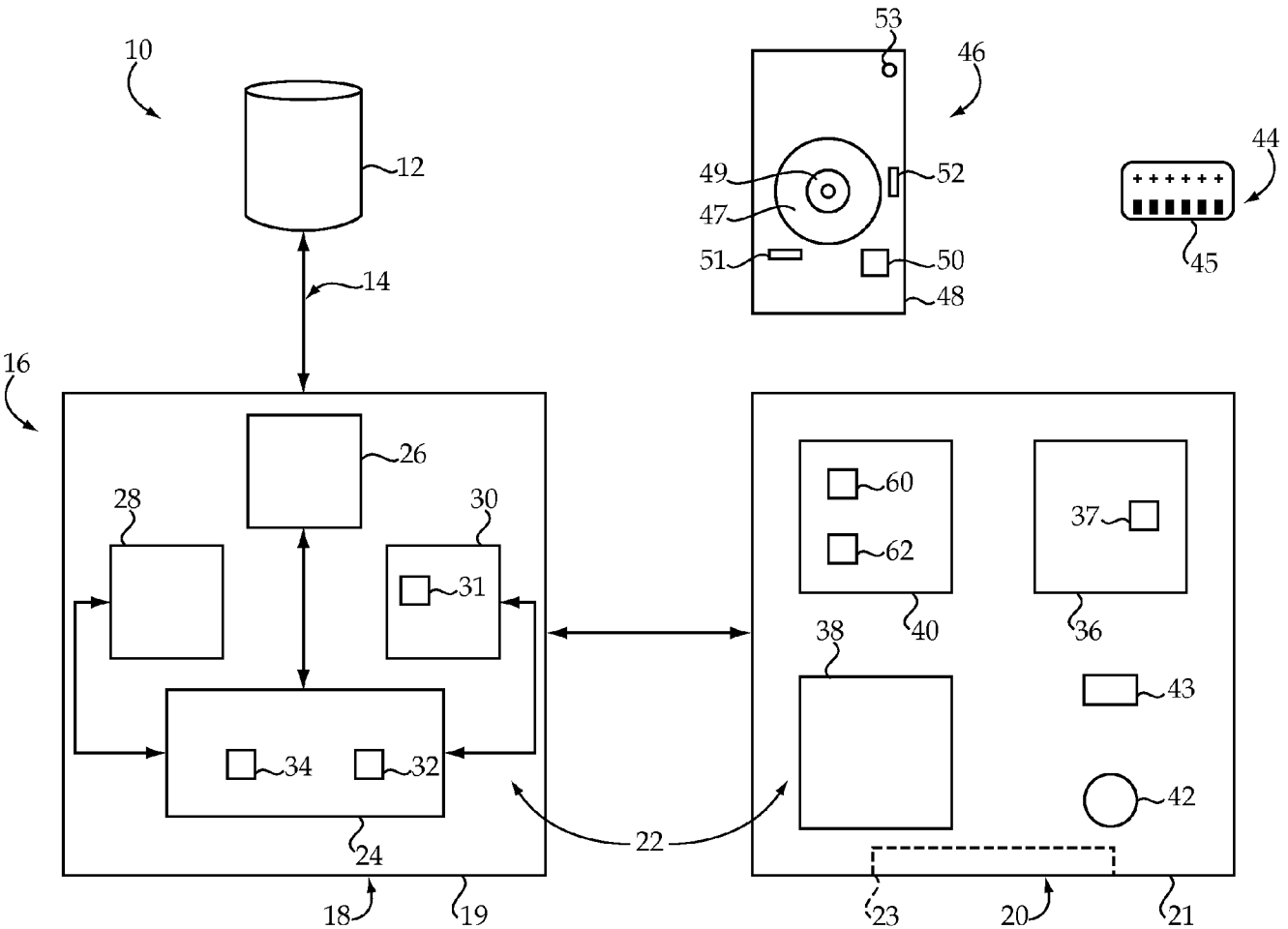
FIG. 1 is a block diagram of a system for controlling circulation of media materials from a library, according to one embodiment.

Referring to FIG. 1, there is shown a system 10 for controlling circulation of media materials from a library, according to one embodiment. System 10 may include a server 12 and a circulation control station 16 in wireless or wired communication with server 12 by way of a communications network 14. In one embodiment, circulation control station 16 may include a first terminal 18 and a second terminal 20. System 10 may further include a control system 22 adapted to monitor and control various functions of system 10 as further described herein. Control system 22 may include one or more computers 24. In the embodiment shown, computer 24 includes a data processor 32 and a computer readable memory 34 storing computer executable instructions. Processor 32 may be configured via executing the computer executable instructions to control various aspects of system 10 during checking out units of media, disabling security features thereof, and releasing media units to circulation, as further described herein. Computer 24 is shown resident on terminal 18, however, in other embodiments computer 24 might instead be resident on terminal 20, or even positioned remotely from terminals 18 and 20 such as at server 12, and remotely control and monitor circulation control station 16. Moreover, while the illustrated embodiment includes multiple terminals, in other versions control station 16 might include only a single terminal.

Terminal 18 and terminal 20 may each be adapted to perform checkout and security disabling procedures for units of securable media in a library or other institutional setting. As used herein, the term "securable media" includes media materials such as books, CD's, DVD's, audio or videotapes, computer disks, magazines, and virtually any item commonly available for checkout from a library or similar institution. Such media may be understood as "securable" where equipped with one or more resident electronic or magnetic security devices, for example, which include at least two different security states such as an enabled or armed state, and a disabled or disarmed state. Apart from conventional libraries, the teachings set forth herein may also be advantageously applied in other contexts such as biological, chemical or geological specimen collections. System 10 or components thereof may also be adapted to perform checkout and security disabling procedures for "packaged" units of securable media, similar to and potentially inclusive of the securable media examples listed above, and having a package component such as a case which includes one or more resident security devices in addition to or instead of a security device resident on the book, DVD, CD, etc. Advantages and further details of applying system 10 to checkout and security disabling of units of media, packaged and unpackaged, will be further apparent from the following description.

Terminal 18 may include a housing 19, and a plurality of different components positioned on or in housing 19. These components may include computer 24, a display or monitor 26, a card scanner 28 such as a magnetic card reader or optical scanning device, and an electronic security control mechanism 30. Electronic security control mechanism 30 may include an RFID reader/writer 31 which is configured to read media identification data stored on a memory device of a unit of securable media, and further configured to adjust a security setting on an electronic security device of a unit of securable media by writing to the electronic security device. To this end, electronic security control mechanism 30 may include a reading mode for reading media identification data from a unit of securable media, and an electronic security disabling mode which includes a write mode for adjusting a security setting of an electronic security device resident on the unit of securable media. RFID reader/writer 31 may include a conventional RF antenna and transmitter mechanism such as those well known in the field of RFID security. The electronic security device resident on a unit of securable media mentioned above may include a conventional RFID tag storing an ID number specific to the unit, and also storing an adjustable security bit, as further described herein. In one practical implementation strategy, terminal 18 may be used at least primarily for checkout and security disabling of media materials such as books and the like which are not customarily packaged in the normal course of library operations.

Terminal 20, in contrast, may be used at least primarily for the purposes of checkout and security disabling of packaged units of securable media such as compact discs, DVD's and the like, which are customarily packaged within a case or the like in the normal course of library operations. Terminal 20 may include a housing 21 defining a receptacle 23 configured to receive a packaged unit of securable media therein. Terminal 20 may further include an electronic security control mechanism 36 mounted to housing 21, and a mechanical security control mechanism 40 also mounted to housing 21. In a manner analogous to that described above with regard to mechanism 30, mechanism 36 may include an RFID reader/writer 37, and have a reading mode for reading media identification data stored on a security device of a packaged unit of securable media, and an electronic security disabling mode which includes a write mode. Mechanical security control mechanism 40 may include a magnet 62 and an actuator 60. Mechanism 40 may further include a rest mode and a magnetic security disabling mode, the significance of which will be apparent from the following description.

Those skilled in the art will appreciate that media materials commonly available for use or checkout from a library may include a variety of different security features. Certain procedures whereby a patron checks out a unit of securable media such as a packaged unit of securable media, and disables the security features, are also well known. As will be further apparent from the following description, system 10 is uniquely configured to perform multiple security control functions in a reduced number of steps compared to earlier designs. In one embodiment, checkout and disabling of multiple different security features may occur in a single step performed by a library patron, or library staff, wishing to checkout a given unit of securable media. As alluded to above, mechanism 36 may be used to disable an electronic security feature of a packaged unit of securable media, while mechanism 40 may be used to disable a magnetic security device of the packaged unit.

Terminal 20 may also include an EAS security deactivator 38. As used herein, the term EAS stands for "Electronic Article Surveillance." A variety of different EAS security devices are well known and widely used in connection with units of securable media. Among such devices is a conventional magnetic strip affixed to a unit of media or a case therefor, upon which a code is stored. If a unit of media with an armed EAS device is passed through a detector or the like positioned in proximity to a library exit, an alarm may be triggered. The stored code on a magnetic strip EAS device may be erased by placing the strip in a magnetic field. Accordingly, in one embodiment, deactivator 38 may include a magnet which is positioned in housing 21 to interact with and disable an EAS strip of a unit of securable media resident within receptacle 23. Disabling an EAS device may take place contemporaneously with disabling of electronic and magnetic security features as mentioned above.

System 10 may also include one or more packaged units of securable media 46. In the embodiment shown, unit 46 may include a media storage component 47 such as a CD, DVD, magnetic storage disk, tape, etc., and a case component 48. Component 47 may be positioned within case component 48, and case component 48 locked via a magnetic security mechanism 52 such as a magnetic lock. An electronic security device 49, which may include an RF security tag, may be positioned on storage component 47. Device 49 may be of the type known in the art generally as a "hub tag." An EAS security device 51 such as a magnetic strip may also be positioned upon or in case component 48. It is also common for packaged units of securable media to include a second electronic security device, such as a second RF security tag 50 positioned on or in case component 48, providing redundant identification of the packaged unit, and allowing confirmation that the correct case is associated with the correct media, as further described herein. Unit 46 may still further include an orientation magnet 53 for enabling control system 22 to determine whether unit 46 is properly positioned within receptacle 23. Terminal 20 may further include an orientation sensor 43 which may include a magnetically sensitive sensor such as a Hall effect sensor for interacting with orientation magnet 53 to determine proper positioning of unit 46 within receptacle 23. Terminal 20 may still further include an indicator 42 such as an LED or the like, which can indicate to a patron when a unit of securable media is properly positioned, or improperly positioned, within receptacle 23. In one example embodiment, indicator 42 might include a green illumination state to communicate to a patron that unit 46 is properly positioned in receptacle 23, and a red illumination state to indicate that unit 46 is not properly positioned. Still other information such as whether a packaged unit of securable media has been unlocked or checked out successfully may be communicated to patrons via indicator 42.

As noted above, control station 16 may include a card scanner 28. System 10 may also include one or more user or patron identification cards 44 having a bar code 45 storing user identification data printed thereon, for example. Those skilled in the art will appreciate that a variety of mechanisms might be used for storing user identification data on card 44, such as electronically readable bar codes, magnetic stripes, or still other indicia of patron identification. In this vein, while one practical implementation strategy includes a laser card scanner 28, in other embodiments a magnetic card reader or the like might be used.

As discussed above, mechanism 36 and mechanism 40 may each include different modes. Upon satisfaction of certain criteria, control system 22, by way of computer 24, may be configured to switch mechanisms 36 and 40 between their respective modes to disable an electronic security device such as device 49 or 50 and a magnetic security device such as device 52 of a unit of securable media while resident within receptacle 23. Disabling such security devices may take place simultaneously, or substantially so. In one embodiment, control station 16 may include a first configuration at which mechanism 36 is in the reading mode and mechanism 40 is in the rest mode, and a second configuration at which mechanism 36 is in the electronic security disabling mode and mechanism 40 is in the magnetic security disabling mode. It will be recalled that mechanism 36 may be configured to read media identification data from a packaged unit of securable media. Control system 22, for example by way of computer 24, may be configured to transmit a release request comprising one or more signals to server 12 responsive to media identification data stored on electronic security device 49, for example. The media identification data might include a bar code number specific to unit 46, for instance. The release request may include a signal sent to server 12 responsive to electronically reading the media identification data from device 49 while unit 46 is resident in receptacle 23. Transmitting the release request may also take place responsive to user identification data such as a user ID number stored on card 44 and scanned via scanner 28. In a manner further described below, a patron may scan their card 44, place unit 46 within receptacle 23, and control system 22 may transmit the release request to server 22 based on the identity of the patron and the identity of the media. Server 12 may be configured to transmit a release authorization signal back to control station 16 in response to the release request. Unit 46 may be released to circulation while resident within receptacle 23 at least in part by switching control station 16 from the first configuration to the second configuration discussed above, responsive to the release authorization. As also discussed above, the electronic security disabling mode of mechanism 36 may include a write mode. In the write mode, mechanism 36 may flip a security bit stored on device 49, for example, to disable/disarm device 49, and could similarly disable a security bit stored on device 50.

Figure 2:
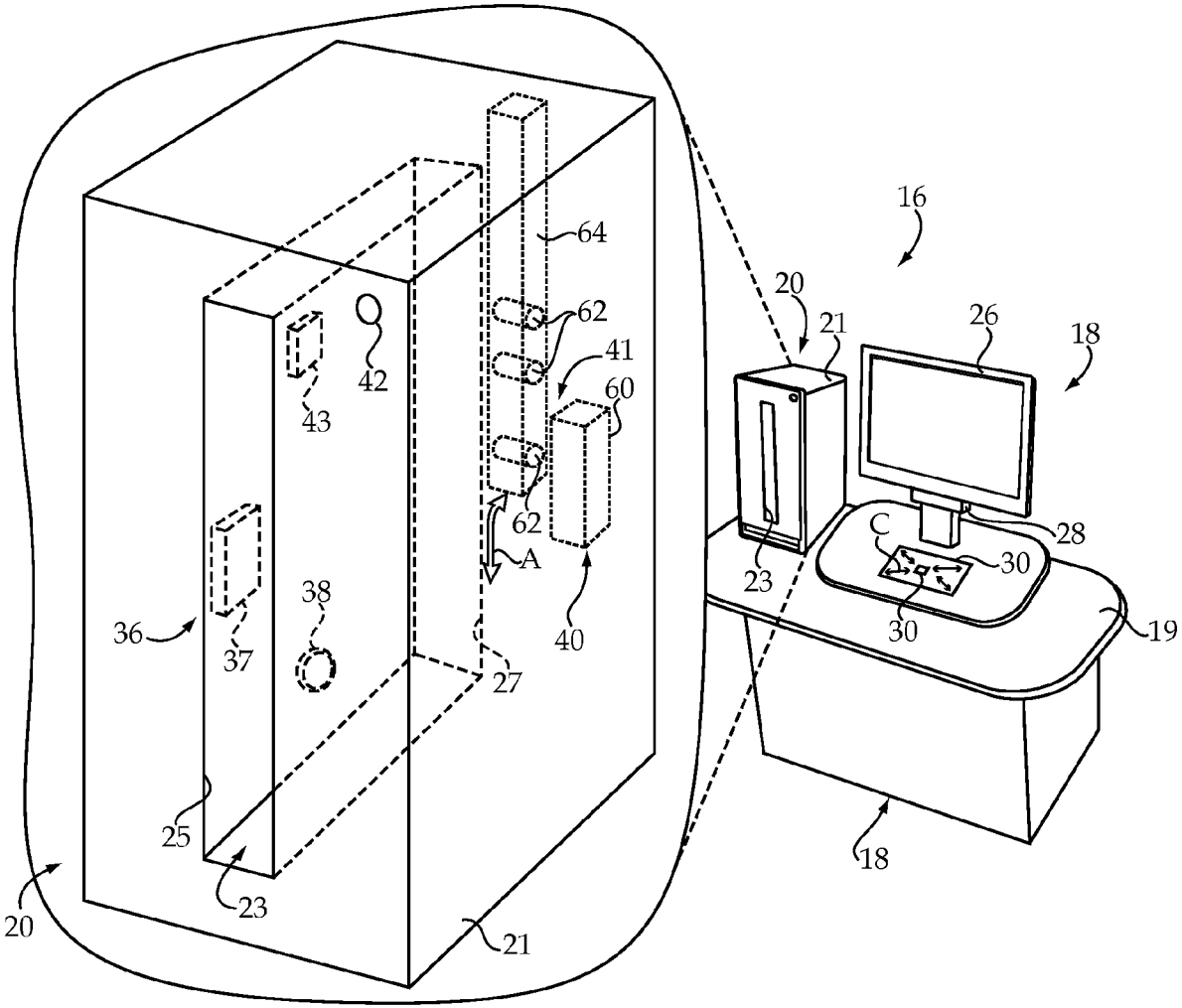
FIG. 2 is a diagrammatic view, including a detailed enlargement of a circulation control station, according to one embodiment.

Referring also to FIG. 2, there is shown a diagrammatic view of control station 16. It may be noted that electronic security control mechanism 30 which includes RFID reader/writer 31 may be positioned on housing 19 and configured as an RF reader/writer pad, having an electronic control range represented approximately via arrows C. Scanner 28 may be mounted to housing 19 via positioning on display 26. Terminal 20 may also be supported on housing 19 and positioned adjacent to terminal 18. It will be recalled that terminal 18 may be used at least primarily for checkout and security disabling of unpackaged media material such as books, whereas terminal 20 may be used for checkout and security disabling of packaged units of securable media such as DVD's, CD's and the like. Control station 16 may be configured such that control system 22 may transmit the release request responsive to media identification data from either of RFID reader/writer 31 or RFID reader/writer 37. These and other features disclosed herein enable an efficient, user controllable self checkout station where, regardless of the type of media materials to be checked out and have their security disabled, a user can scan their identification card, check out the materials, and disable any electronic and/or magnetic security features literally in a matter of seconds.

FIG. 2 also illustrates certain example features of terminal 20 in greater detail. As shown in FIG. 2, receptacle 23 may include a generally vertically oriented rectangular receptacle having a first, open end 25 and a second, blind end 27. Receptacle 23 may be configured to receive a packaged unit of securable media therein. In the embodiment of FIG. 2, magnet 62 may include a plurality of permanent magnets such as rare earth magnets, which are movable relative to housing 21 between a first position spaced from second end 27 of receptacle 23, and a second position adjacent second end 27 of receptacle 23. Mechanical security control mechanism 40 may be configured to adjust magnets 62 between the first position and the second position. To this end, mechanism 40 may further include a magnet positioning mechanism 41 having an actuator 60 and an actuatable component 64 such as a carriage to which magnets 62 are mounted. In FIG. 2, magnets 62 are shown at their first position, spaced from second end 27. Control system 22 may be configured to output an actuator control signal to actuator 60 which actuates positioning mechanism 41 and moves magnets 62 relative to a packaged unit of securable media resident within receptacle 23 in response to actuating magnet positioning mechanism 41. Magnet 62 may be mounted to component 64 as mentioned above, and movable by way of a compound travel path shown via arrow A between the first position and second position. The compound travel path may include a forward component and a downward component, from the first position to the second position of magnets 62. Also shown in FIG. 2 are electronic security control mechanism 36, EAS deactivator 38, and orientation sensor 43, each of which may be positioned to interact with a packaged unit of securable media resident in receptacle 23, as further described herein.

Figure 3:
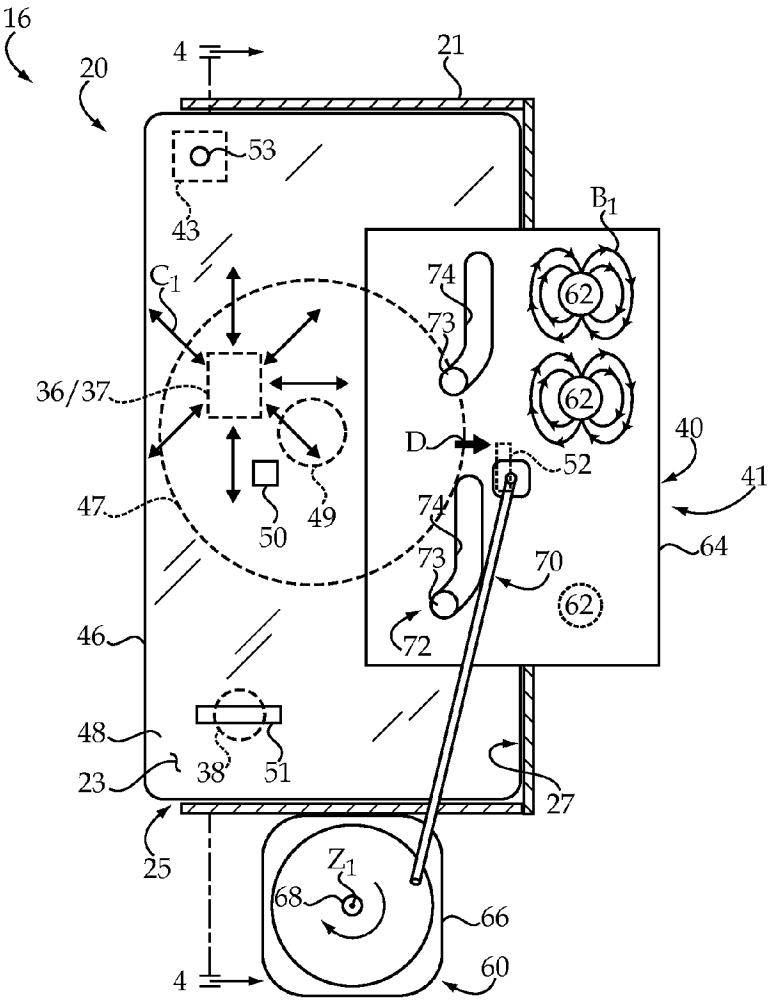
FIG. 3 is a partially sectioned side diagrammatic view of a portion of the circulation control station of FIG. 2, in a first configuration.

Referring also to FIG. 3, there is shown terminal 20 in a first configuration, and illustrating further example details thereof. In FIG. 3, packaged unit 46 has been positioned within receptacle 23 such that it contacts or is positioned proximate to second end 27. In the configuration shown in FIG. 3, it may also be noted that orientation magnet 53 is positioned adjacent to orientation sensor 43. Orientation sensor 43 may be coupled with computer 24 of control system 22, such that a state of sensor 43 can indicate whether an orientation magnet has been sensed, and thus indicate that an associated packaged unit of securable media is inserted properly, instead of upside down for example. EAS deactivator 51 is positioned adjacent EAS device 38 and can function either automatically or by way of control from control system 22 to deactivate/disarm EAS device 38.

Also shown in FIG. 3, in phantom, are certain other components of packaged unit 46. Media storage component 46 having security device 49 mounted thereon, is positioned within case component 48. With unit 46 positioned as shown, electronic security device 49 and also electronic security device 50 are positioned within an electronic control range defined by mechanism 36 and illustrated via arrows $C_1$. Where unit 46 has been admitted into receptacle 23 approximately as shown in FIG. 3, an electronic communication link such as an RF communication link has been established between mechanism 36 and each of devices 49 and 50. Changing a position of device 49/50 via moving unit 46 into receptacle 23 may position device 49/50 within range $C_1$, to establish the electronic communication link. Mechanism 36 may be in its reading mode in FIG. 3, whereby media identification data stored on one or both of devices 49 and 50 may be read.

Mechanical security control mechanism 40 is shown in FIG. 3 as it might appear in its rest mode, at which magnets 62 are at their first position spaced from second end 27 of receptacle 23. An arrow D is shown in FIG. 3 and shows an approximate position of magnetic security device or magnetic lock 52 within case component 48. In the embodiment depicted in FIG. 3, case component 48 may be of a type known as a Clear-Vu One-Time™ security case. The details of security cases of this type are well known in the art, and are thus not specifically described herein.

It may be noted from FIG. 3 that first end 25 of receptacle 23, and possibly all of receptacle 23, is within electronic control range $C_1$. Since magnet positioning mechanism 41 may be actuated to change a position of magnets 62, a magnetic control range $B_1$ defined by mechanism 40 may be understood to be based both on a magnetic field strength of magnets 62 and also on a range of motion available by actuating magnet positioning mechanism 41. Accordingly, second end 27 of receptacle 23 is positionable within magnetic control range $B_1$ by moving magnets 62, even though in the FIG. 3 illustration magnets 62 are spaced from second end 27, and device 52 is presently positioned such that it is not affected by magnets 62. Changing a position of magnets 62 may be understood to position device 52 within control range $B_1$. In FIG. 3, arrow D represents a first position of device 52 such as a position it might occupy relative to case component 48 when in a locked state.

Figure 4:
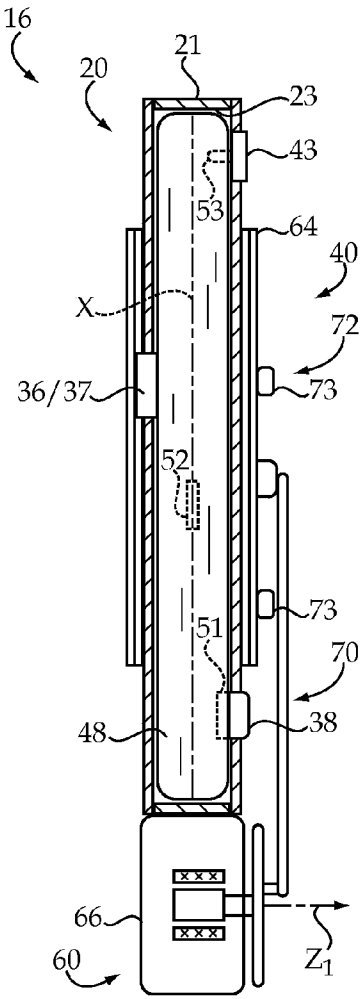
FIG. 4 is a partially sectioned view taken along line 4-4 of FIG. 3.

Referring also to FIG. 4, there is shown a view taken approximately along line 4-4 of FIG. 3. Actuator 60 may include an electric motor 66 in one embodiment. In one further embodiment, motor 66 might include a brushless stepper motor, however, the present disclosure is not thereby limited. In still other embodiments, actuator 60 might include a linear electrical actuator, or even a pneumatic or hydraulic actuator or the like. Motor 66 may include a spindle 68 defining an axis of motor rotation $Z_1$. In FIGS. 3 and 4, spindle 68 is shown at a first angular position about axis $Z_1$, occupied in the rest mode of mechanism 40. Mechanism 40 may further include a connecting mechanism 70 which extends between component or carriage 64 and motor 66. Connecting mechanism 70 may be coupled with motor 66 such that rotation of motor 66 causes motion of carriage 64, and corresponding motion of magnets 62 between their first position and second position. Mechanism 40 may still further include a guide 72 having one or more pins 73 which are fixedly attached to housing 21. One or more guide channels 74 may be formed in carriage 64, within which pins 73 are received. In the illustrated embodiment, channels 74 include J-channels such that movement of carriage 64 will tend to cause magnets 62 to traverse the compound travel path shown in FIG. 2 via arrow A. Moving magnets 62 in the compound travel path can result in magnets 62 approaching and then sliding downward along second end 27 of receptacle 23, establishing a magnetic communication link with device 52, such as a magnetic field link once device 52 is positioned within range $B_1$. When carriage 64 reverses, and slides upward according to the compound travel path, a magnetic field of magnets 62 can create a magnetic drag on device 52 and move device 52 upward to an unlocked position within case component 48, disabling magnetic security device 52.

Figure 5:
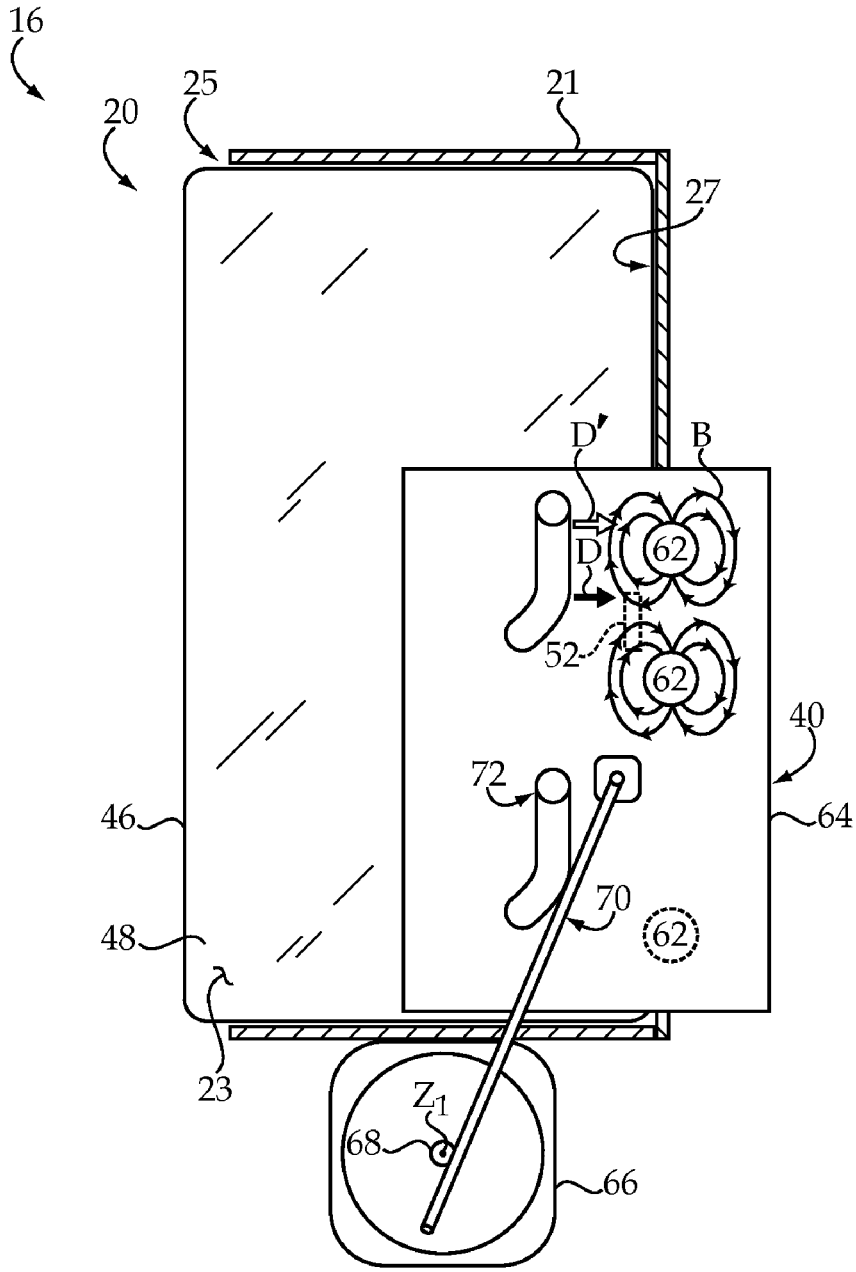
FIG. 5 is a partially sectioned side diagrammatic view of a portion of the circulation control station of FIG. 2, in a second configuration.

Referring to FIG. 5, there is shown terminal 20 in a second configuration, at which motor 66 has been rotated such that spindle 68 occupies a different angular position about axis $Z_1$, carriage 64 has moved leftward and downward relative to its position shown in FIGS. 3 and 4, and magnets 62 have been slid along second end 27 of receptacle 23 to position mechanism 52 within range/field $B_1$. Just prior to or during moving magnets 62 from their position depicted in FIG. 5, control system 22 may, by way of computer 24, output a control signal to mechanism 36, switching it to its write mode to flip the security bit on device 49 and/or 50 to disable the same. With devices 49 and 52 disabled, unit 46 may be released to circulation. The control signals to mechanisms 36 and 40 may be generated responsive to the release authorization from server 12. Arrow D represents the approximate locked position of device 52 and occupies the same location as arrow D in FIG. 3. A second arrow D' shows an appropriate position to which device 52 will move as magnets 62 and carriage 64 are moved back toward their rest position. From the state shown in FIG. 5, motor 66 may be further rotated, and guide 72 can function to guide carriage 64 and magnets 62 back towards the first position of magnets 62, dragging device 52 upward to unlock unit 46. In the embodiment shown, a total of three magnets 62 are used, with two positioned on one side of carriage 64, and another positioned lower down and on an opposite side of carriage 64, however, the present disclosure is not thereby limited. Magnets 62 may include a number and/or arrangement based on the type(s) of security devices to be unlocked. In the illustrated embodiment at least two different types of magnetic security devices may be unlocked/disabled, such as CD's and BluRay cases versus DVD cases, by magnetically interacting with different subsets of magnets 62.

Figure 6:
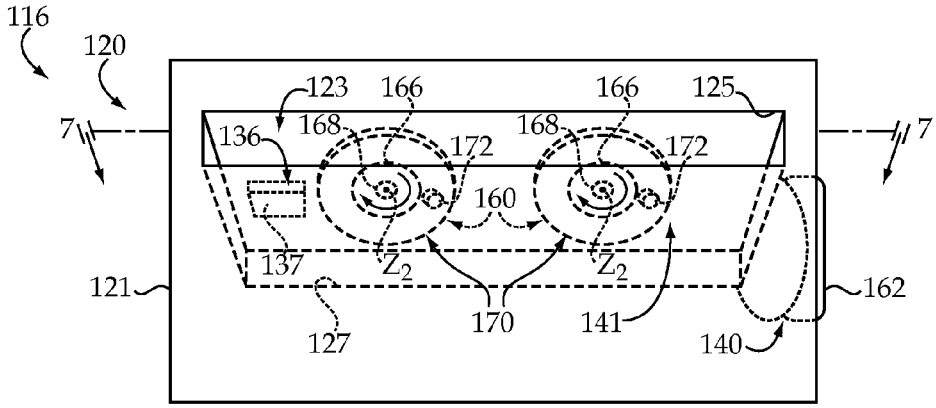
FIG. 6 is a perspective view of a circulation control station, according to another embodiment.

Turning now to FIG. 6, there is shown a circulation control station 116 according to another embodiment, and having a terminal 120 for checking out and unlocking a packaged unit of securable media. It should be appreciated that the terminal concept shown in FIG. 6 might be used in system 10, and with circulation control station 16 instead of or in addition to terminal 20. Terminal 120 may be specially configured for unlocking packaged units of securable media of a different type than that contemplated for use with terminal 20 such as those having a case component known as a "Kwik Case." Accordingly, a system for controlling circulation of media materials from a library according to the present disclosure might include a first terminal such as terminal 18, a second terminal such as terminal 20, and a third terminal such as terminal 120. For purposes of the present description, it may be assumed that terminal 120 could be substituted for terminal 20 and controlled in an identical or similar manner, except where otherwise indicated.

Terminal 120 may operate in a manner having similarities with that of terminal 20, and also certain differences. Terminal 120 may include a housing 121 defining a receptacle 123 having a first, open end 125, and a second, blind end 127. Receptacle 123 may be configured to receive a packaged unit of securable media therein. An electronic security control mechanism 136 having an RFID reader/writer 137 may be mounted to housing 121, and includes a reading mode for reading media identification data from a packaged unit of securable media resident in receptacle 123, and also including an electronic security disabling mode which includes a write mode. Terminal 120 may further include a mechanical security control mechanism 140 having a magnet 162 and an actuator 160. Mechanism 140 may also include one or more actuators 160. In the illustrated embodiment, two actuators are shown, however, other versions might include three actuators or a single actuator, for example. In a single actuator version, the one actuator might be positioned intermediate the locations shown for actuators 160, or one of actuators 160 might simply be omitted from the design, and no other substantive changes made. One or more linear actuators, or a toothed wheel and gear rack type actuator system could be used to perform functions similar to those described herein. In one embodiment, each of actuators 160 may include an electric motor 166 which includes a spindle 168, each spindle 168 having a first angular position about an axis of motor rotation $Z_2$ in a rest mode of mechanism 140, and a second angular position about axis $Z_2$ in a magnetic security disabling mode of mechanism 140. Magnet 162 may include a fixed position relative to housing 121, adjacent second end 127 of receptacle 123, in contrast to the movable magnet configuration of terminal 20. Mechanism 40 may further include a magnet access inhibiting mechanism 141 having, hereafter "inhibiting mechanism 41," a closed state and an open state. Inhibiting mechanism 141 may be coupled with actuators 160 and be in the closed state in the rest mode, and in the open state in the magnetic security disabling mode. Inhibiting mechanism 141 may further include a set of pins 172 coupled with each actuator 160 and extending into receptacle 123. Each motor 166 may include a brushless stepper motor, similar to motor 60 of terminal 20. Actuating motors 166 can induce rotation of actuators 160 to change a position of pins 172 within receptacle 123.

Figure 7:
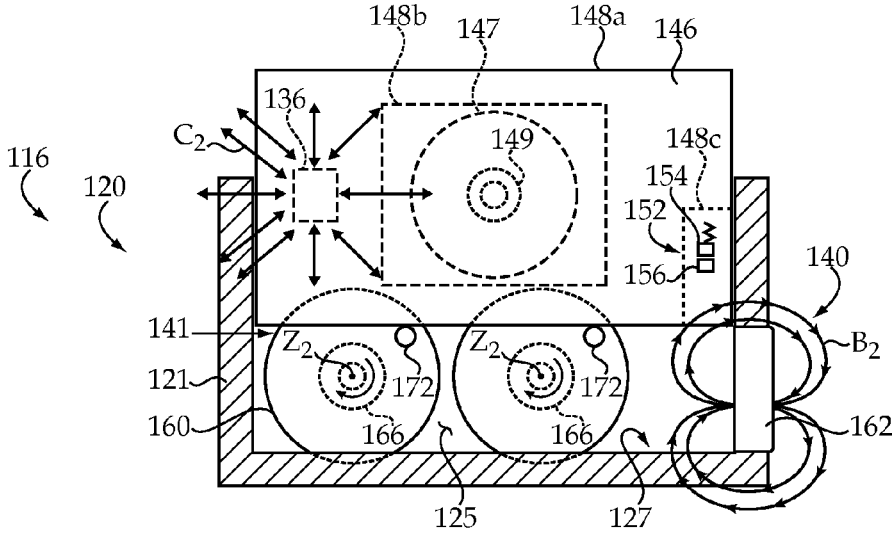
FIG. 7 is a partially sectioned view taken along line 7-7 of FIG. 6, illustrating the circulation control station in a first configuration.

Referring to FIG. 7, there is shown terminal 120 with inhibiting mechanism 141 in the closed state it might occupy when mechanism 140 is in the rest mode. A packaged unit of securable media 146 is positioned within receptacle 123 and rests on pins 172. In the configuration depicted in FIG. 7, an electronic security device 149 of a media storage component 147 of packaged unit 146 is positioned within an electronic control range $C_2$ defined by mechanism 136. Packaged unit 146 may further include a plurality of different case components, including an outer case component 148*a*, an inner case component 148*b*, and a third case component 148*c* or case locking component. Those skilled in the art will readily recognize the multi-component packaging configuration of packaged unit 146, in which case component 148*b* is identical or similar to a conventional CD or DVD case, and positioned within outer case component 148*a* for security purposes. Case component 148*c* may further include a magnetic security device 152 which includes a lock such as a spring-loaded lock 154, and a magnetically sensitive pin 156. In the configuration shown in FIG. 7, magnetic security device 152 is outside of a magnetic control range $B_2$ defined by mechanical security control mechanism 140. At the state shown in FIG. 7, mechanism 136 may read media identification data from device 149 and, via control system 22 for example, a release request transmitted to server 12. Server 12 may transmit a release authorization back to control station 116 in response to the release request.

Figure 8:
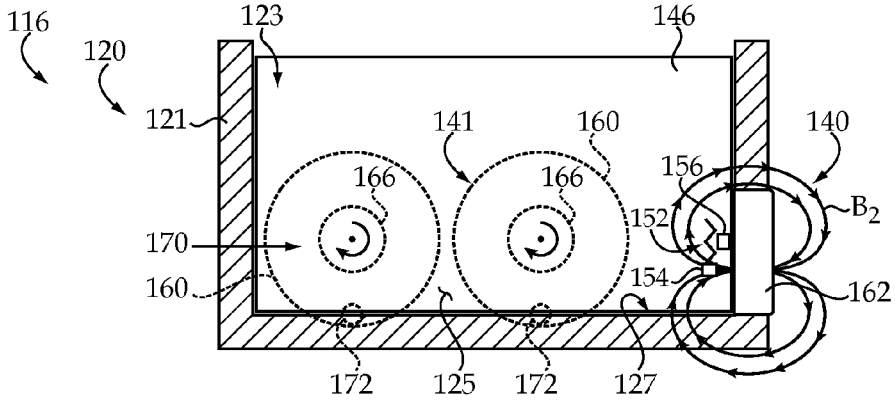
FIG. 8 is a partially sectioned view similar to FIG. 6, illustrating the circulation control station in a second configuration.

Turning to FIG. 8, there is shown terminal 120 in a different configuration at which magnet access inhibiting mechanism 141 has been switched from its closed state as shown in FIG. 7, to an open state. Switching to the open state may occur upon switching mechanism 140 to its magnetic security disabling mode. Each of motors 166 has been rotated, to rotate actuators 160, and consequently swing pins 172 to a lower position close to or past second end 127 of receptacle 123. Contemporaneous with actuating motors 166, mechanism 136 may be switched to its electronic security disabling mode, and flip the security bit stored on device 149. In the configuration shown in FIG. 8, packaged unit 146 has been slid, for example under the force of gravity, to a position within receptacle 123 at which it contacts second end 127 or some other stop feature. Magnetic security device 152 has been positioned, by way of sliding of unit 146, within magnetic control range $B_2$ to establish a magnetic communication link with mechanism 140, and pin 156 has been moved out of the way of spring-biased lock 154 via a field of magnet 162. In the configuration shown in FIG. 8, magnetic security device 152 has been disabled, and packaged unit 146 is unlocked. When unit 146 slides under the force of gravity to contact second end 127 of receptacle 123, a jarring or physical shock may be imparted to unit 146, assisting in moving pin 156 out of the way of component 154. At the state shown in FIG. 8, unit 146 may be released to circulation, and motors 166 further rotated to urge unit 146 back out of receptacle 123.

Returning to FIGS. 2 and 3, the electronic control range defined by mechanism 36 may include a first electronic control range, and the electronic control range defined by mechanism 30 may include a second electronic control range. It will further be recalled that mechanical security control mechanism 40 defines a magnetic control range. In one embodiment, each of the first electronic control range and the magnetic control range is non-overlapping with the second electronic control range. In other words, there may be no point in space within the second electronic control range and also within either or both of the first electronic control range and the magnetic control range, although points in space may exist which are within both the first electronic control range and the magnetic control range, such as portions of receptacle 23.

INDUSTRIAL APPLICABILITY

Figure 9A:
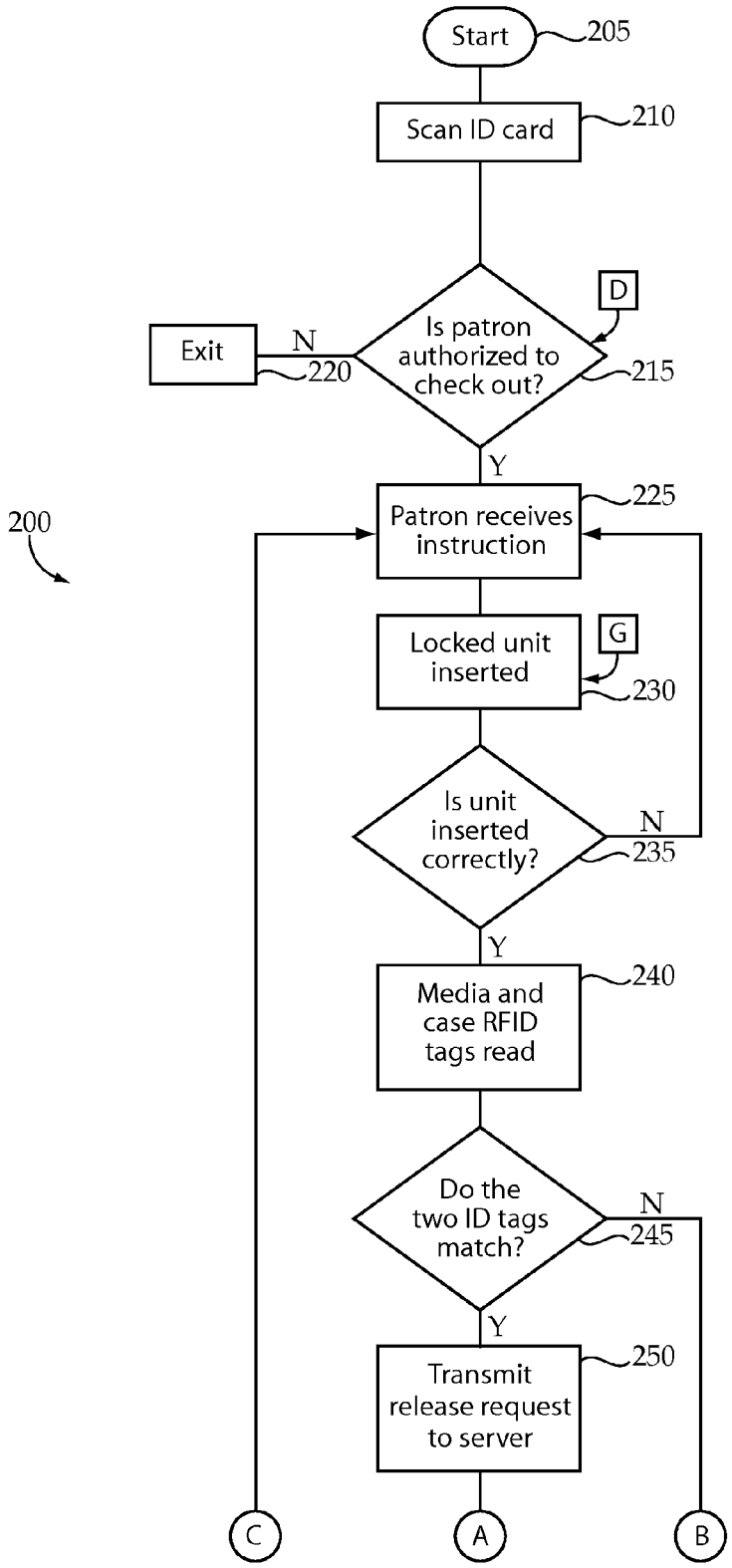
FIG. 9*a* is a flowchart illustrating a portion of a process, according to one embodiment.

Referring now to FIG. 9*a*, and also with reference to the other drawings, there is shown a portion of a control process according to one embodiment by way of a flowchart 200. The following description emphasizes functions and features of terminal 20, but should be understood to refer similarly to terminal 120 except where otherwise indicated. It should further be understood that the presently described process may be carried out by executing instruction stored on memory 34 via processor 32, however, the present disclosure is not thereby limited. The process of flowchart 200 illustrates a media checkout and security disabling procedure having certain actions undertaken by a patron or other user, and other actions performed electronically such as by computer 24 of control system 22. Flowchart 200 is discussed herein in reference to system 10 and terminal 20, but could analogously be applied to any of the embodiments contemplated herein. The process of flowchart 200 may begin at a start or initialize step 205, and may proceed to a step 210, at which a patron scans an ID card, for example scanning ID card 44 at scanner 28. Scanner 28 may electronically read user identification data stored on card 44, and communicate such data to processor 32. From step 210, the process may proceed to step 215 at which a component of system 10 such as server 12 or computer 24 may query whether the patron is authorized to check out. Step 210 might entail comparing the user identification data with a database of user ID's to confirm that the identified user is in fact authorized to checkout materials to circulation. If yes, the process may proceed to step 225. If no, the process may exit at step 220.

At step 225, the patron may receive instructions, such as instructions displayed on display 26 advising the patron of what to do to continue the checkout process. In one embodiment, the instructions may include instructions to the patron to insert a locked item such as unit 46 into an unlocking device such as terminal 20. From step 225, the process may proceed to step 230 at which the patron inserts the locked item into receptacle 23 of the corresponding terminal 20. From step 230, the process may proceed to step 235 to query whether the unit is inserted correctly into receptacle 23. Step 235 might include, for example, checking a state of orientation sensor 43 to determine whether an orientation magnet has been detected. If no, the process may return to step 225, instructing the patron to reorient and reinsert the unit, for example. If the unit is correctly inserted at step 235, the process may proceed to step 240 at which the media and case RFID tags are each read. Step 240 may thus include reading media identification data from each of devices 49 and 50, for instance. From step 240, the process may proceed to step 245 to query whether the two RFID tags match. If no, the process may proceed to step 270 to display a failure message to the patron, and potentially also to a staff member, or otherwise log a fault condition. If, at step 245, the RFID tags match, the process may proceed to step 250.

During admitting the packaged unit into receptacle 23 such as in step 230, an electronic communication link may be established between electronic security control mechanism 36 and security device 49. As explained above, establishing an electronic communication link may include positioning security device 49 (and/or 50) within an electronic control range defined by mechanism 36. Control system 22, by way of computer 24 for example, may transmit a release request from circulation control station 16 responsive to the media identification data in step 250. In one embodiment, the release request might include a bar coded number for the packaged unit within receptacle 23 and also user identification data, transmitted over communications network 14 to server 12. From step 250, the process may proceed to step 255.

In step 255, server 12 may receive the release request and perform conventional check out procedures, such as determining whether the particular patron is authorized to checkout a particular unit of media. If, at step 255 checkout is not okay, the process may proceed to step 270. If checkout is indeed okay, from step 255 the process may proceed to step 260 in which circulation data such as the media identification data and the patron identification data are electronically recorded. From step 260, the process may proceed to step 265 at which server 12 may transmit a release authorization to circulation control station 16, responsive to the release request and subsequent to checking out unit 46. Control station 16 may receive the release authorization, and responsively activate the security disabling functions of terminal 20 at step 275.

Step 275 may include establishing a magnetic communication link between the packaged unit and mechanical security control mechanism 40 responsive to the release authorization. Establishing a magnetic communication link may further include changing a position of magnetic security device 52 relative to magnets 62. It may be noted that establishing a magnetic communication link may take place subsequent to admitting the packaged unit into receptacle 23. Changing a position of magnetic security device 52 may include positioning device 52 within a magnetic control range defined by mechanism 40 as described above. In the case of terminal 20, this may include moving magnets 62. In the case of terminal 120, this may include moving packaged unit 146. In the case of either of terminals 20 or 120, changing a position of the magnetic security device relative to the magnet 62, 162, may include outputting an actuator control signal. Magnet positioning mechanism 41 may be actuated in terminal 20 by way of the actuator control signal, resulting in magnet 62 moving relative to packaged unit 46 and device 52. Magnet access inhibiting mechanism 141 may be actuated in terminal 120 by way of the actuator control signal, such that a position of device 152 is changed by moving unit 146, under the force of gravity, in response to actuating mechanism 141. As noted above, allowing packaged unit 146 to jar slightly upon contacting second end 127 can assist in ensuring that mechanism 152 is indeed switched to an unlocked position. As also discussed above, mechanism 36 may flip the security bit on unit 46, such that magnetic security and electronic security are both disabled, in step 175.

From step 275, the process may proceed to step 280 to query whether the case is properly unlocked. Step 280 might include displaying this query on display 26 to a patron, for example. If no, the process may proceed to step 285 in which the still locked media unit may be reinserted into receptacle 23 in response to instructions on display 26. From step 285, the process may proceed to step 290 in which a verification process is initiated. The verification process may include, for example, checking the security bit stored on security device 49 or comparing a running list stored locally on memory 34 with the media identification data to determine if the subject item has been checked out. These verification process steps are condensed into step 300, in which it is queried whether the item is already checked out. If no, the process may return via box D to execute step 215 again. If yes, the process may proceed via box F to execute step 275 again. If, at step 280, it is determined that the item is properly unlocked, the process may proceed to step 302 to query whether the patron wishes to continue. If yes, the process may return via box C to execute step 225 again. If no, the process may proceed to step 305 to end. Once checkout and security disabling concludes, the unit of media is released to circulation.

Figure 9B:
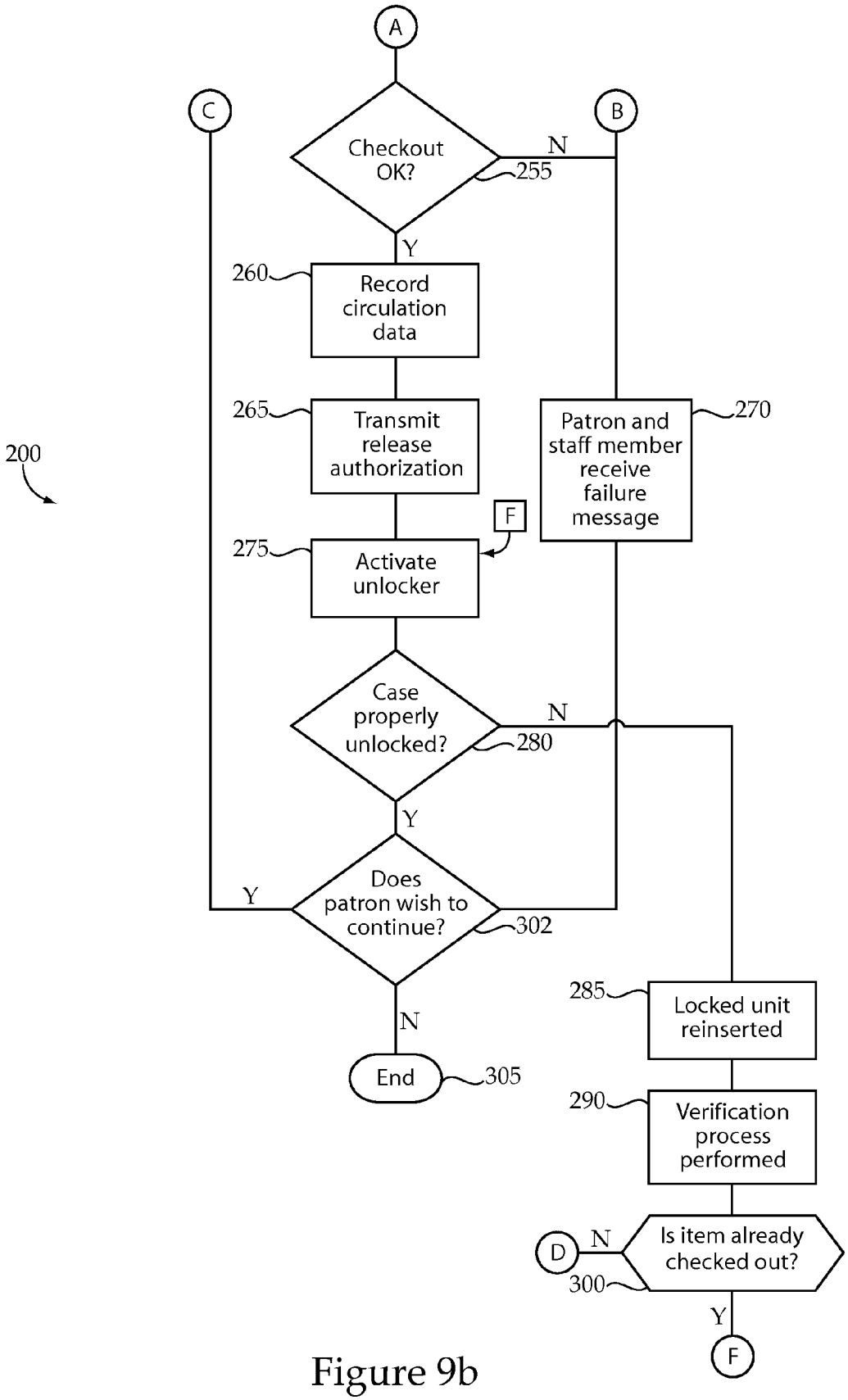
FIG. 9*b* is a flowchart illustrating another portion of the process depicted in FIG. 9*a*.
Figure 10:
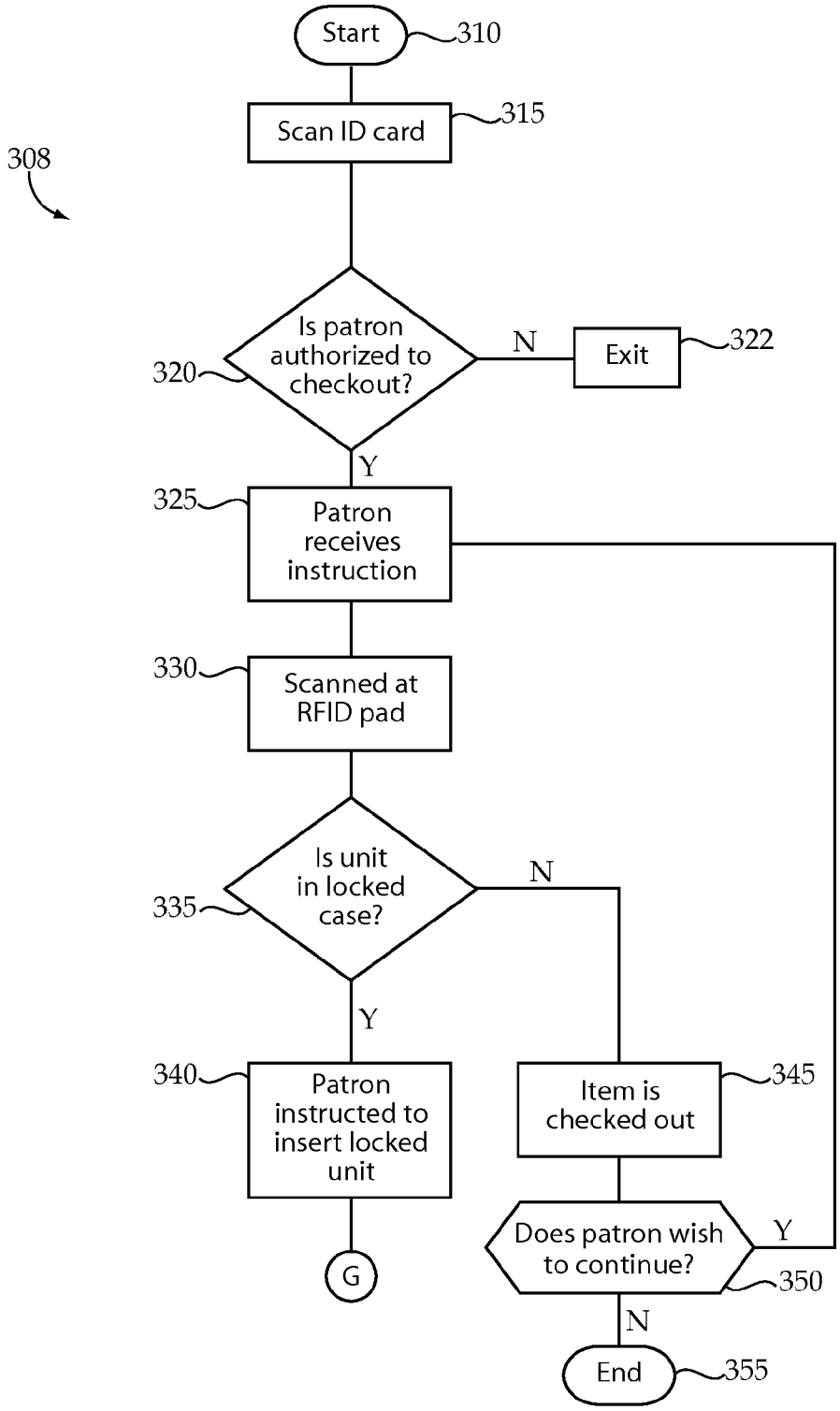
FIG. 10 is a flowchart illustrating a portion of a process, according to another embodiment.

Turning now to FIG. 10, there is shown another control process represented by way of a flowchart 308. The process of flowchart 308 may start at step 310, and proceed to step 315 to scan the patron's ID card, in a manner analogous to that described with regard to the process of FIGS. 9*a* and 9*b*. From step 315, the process may proceed to step 320 to query whether the patron is authorized to check out, again analogous to that described above. If no, the process may exit at step 322. If yes, the process may proceed to step 325. At step 325, the patron may receive instructions, for example displayed on display 26, as to how to proceed. In one embodiment, the patron may be instructed to place the unit within receptacle 23. In some instances, patrons may not proceed as instructed, and instead of placing the unit within receptacle 23 may place the unit on the RFID pad (mechanism 30). The process of flowchart 308 thus may be understood as procedural steps followed in the event of a patron mistakenly placing a packaged unit of securable media on the RFID pad for scanning, instead of inserting it into receptacle 23 as instructed. Flowchart 308 also includes procedural steps similar to those followed where a non-packaged unit of securable media such as a book is placed on the RFID pad for scanning and checkout.

From step 325, the process may proceed to step 330 in which the media unit is scanned at mechanism 30, for example. From step 330, the process may proceed to step 335 to query whether the unit is in a locked case. Again, this query could include instructions to the patron displayed on display 26. If no, the process may proceed to step 345 in which the item is checked out in a manner similar to that described above by communicating with server 12. From step 345, the process may proceed to step 350 to query whether the patron wishes to continue. If yes, the process may return to execute step 325 again. If no, the process may proceed to step 355 to end.

If, at step 335 the item is determined to be in a locked case, the process may proceed to step 340 at which the patron is instructed to insert the locked item into receptacle 23 of terminal 20, for example. From step 340, the process may proceed via box G to execute steps substantially identical to those shown in flowchart 200, and beginning at step 230.

In accordance with the present disclosure, an entire checkout and security disabling procedure for packaged units of securable media may be performed while a packaged unit is resident within a receptacle of an unlocking device such as one of terminals 20 or 120. This can ensure that an item whose security is disabled is indeed the item which is checked out, improving over earlier strategies which commonly checked out a unit of media, and then enabled an unlocking device which could actually be used to unlock any unit of media, not just the one checked out. The procedures described herein also enable a patron-controlled one-step operation, eliminating the need for patrons to first check out each item, and then unlock each item, using separate devices or stations.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims.

What is claimed is:

1. A method of controlling circulation of media materials comprising the steps of:

electronically reading media identification data from a packaged unit of securable media resident within a receptacle of a circulation control station;

transmitting a release request from the circulation control station responsive to the media identification data;

receiving a release authorization transmitted to the circulation control station responsive to the release request;

establishing a magnetic communication link between the packaged unit and a mechanical security control mechanism, responsive to the release authorization; and releasing the packaged unit to circulation at least in part by disabling each of an electronic security device and a magnetic security device of the packaged unit while resident within the receptacle.

2. The method of claim 1 further comprising a step of establishing an electronic communication link between an electronic security control mechanism and the electronic security device during admitting the packaged unit into the receptacle.

3. The method of claim 2 wherein:

the step of establishing an electronic communication link further includes changing a position of the electronic security device relative to a sensor of the electronic security control mechanism, during admitting the packaged unit into the receptacle; and the step of establishing a magnetic communication link further includes changing a position of the magnetic security device relative to a magnet of the mechanical security control mechanism, subsequent to admitting the packaged unit into the receptacle.

4. The method of claim 3 wherein disabling the electronic security device further includes electronically writing to a security tag resident on a media storage component of the packaged unit via an RF communication link, and wherein disabling the magnetic security device further includes unlocking a magnetic lock resident on a case component of the packaged unit via a magnetic field communication link.

5. The method of claim 4 wherein:

changing a position of the electronic security device further includes positioning the security tag within an electronic control range defined by the electronic security control mechanism via moving the packaged unit; and changing a position of the magnetic security device further includes positioning the magnetic lock within a magnetic control range defined by the mechanical security control mechanism via moving at least one of the packaged unit and a permanent magnet.

6. The method of claim 5 further comprising the steps of:

receiving user identification data from a card scanner;

checking out the packaged unit at least in part by electronically recording the user identification data and the media identification data at a remote server, subsequent to admitting the packaged unit into the receptacle; and transmitting the release authorization from the remote server responsive to the user identification data and the media identification data, subsequent to checking out the packaged unit.

7. The method of claim 5 wherein the step of changing a position of the magnetic security device further includes the steps of outputting an actuator control signal, and actuating a magnet access inhibiting mechanism via the actuator control signal.

8. The method of claim 7 wherein the step of changing a position of the magnetic security device further includes moving the packaged unit under the force of gravity in response to actuating the magnet access inhibiting mechanism.

9. The method of claim 5 wherein the step of changing a position of the magnetic security device further includes the steps of outputting an actuator control signal, actuating a magnet positioning mechanism via the actuator control signal, and moving the permanent magnet relative to the packaged unit in response to actuating the magnet positioning mechanism.

10. A circulation control station for securable media materials comprising:

a housing defining a receptacle including a first, open end and a second, blind end, the receptacle being configured to receive a packaged unit of securable media therein;

an electronic security control mechanism mounted to the housing and including a reading mode for reading media identification data from the packaged unit of securable media, and an electronic security disabling mode which includes a write mode;

a mechanical security control mechanism mounted to the housing and including a magnet and an actuator, and further having a rest mode, and a magnetic security disabling mode; and a computer coupled with each of the security control mechanisms, the computer being configured to output a release request responsive to the media identification data, and to receive a release authorization generated in response to the release request;

the computer being further configured to release the packaged unit to circulation at least in part by switching the electronic security control mechanism to the electronic security disabling mode and switching the mechanical security control mechanism to the magnetic security disabling mode, responsive to the release authorization.

11. The control station of claim 10 wherein the electronic security control mechanism includes an RF reader/writer, and defines an electronic control range, wherein the mechanical security control mechanism includes a permanent magnet, and defines a magnetic control range, and wherein the first end of the receptacle is within the electronic control range and outside of the magnetic control range and the second end of the receptacle is within the magnetic control range.

12. The control station of claim 11 wherein the actuator includes an electric motor which includes a spindle defining an axis of motor rotation, the spindle having a first angular position about the axis of motor rotation in the rest mode, and a second angular position about the axis of motor rotation in the magnetic security disabling mode.

13. The control station of claim 11 wherein the magnet includes a fixed position relative to the housing, adjacent the second end of the receptacle.

14. The control station of claim 13 wherein the mechanical security control mechanism further includes a magnet access inhibiting mechanism having a closed state and an open state, the magnet access inhibiting mechanism being coupled with the actuator and being in the closed state in the rest mode and being in the open state in the magnetic security disabling mode.

15. The control station of claim 11 wherein the magnet is movable relative to the housing between a first position spaced from the second end of the receptacle, and a second position adjacent the second end of the receptacle.

16. The control station of claim 15 wherein the mechanical security control mechanism further includes a guide component having a fixed position relative to the housing and a movable carriage coupled with each of the actuator and the guide component, and wherein the magnet is mounted to the movable carriage and movable via a compound travel path between the first position and the second position.

17. The control station of claim 10 wherein the computer is further configured to switch the electronic security control device to the electronic security disabling mode via outputting a first control signal responsive to the release authorization and to switch the mechanical security control device to the magnetic security disabling mode via outputting a second control signal responsive to the release authorization.

18. A system for controlling circulation of media materials from a library comprising:

a control system which includes at least one computer;

a circulation control station including a housing defining a receptacle configured to receive a packaged unit of securable media therein, an electronic security control mechanism mounted to the housing, and a mechanical security control mechanism also mounted to the housing, each of the security control mechanisms being coupled with the control system;

the electronic security control mechanism having a reading mode for reading media identification data from a packaged unit of securable media, and an electronic security disabling mode which includes a write mode, and the mechanical security control mechanism having a rest mode and a magnetic security disabling mode;

the circulation control station further having a first configuration at which the electronic security control mechanism is in the reading mode and the mechanical security control mechanism is in the rest mode, and a second configuration at which the electronic security control mechanism is in the electronic security disabling mode and the mechanical security control mechanism is in the magnetic security disabling mode; and the control system being configured to transmit a release request to a server responsive to the media identification data, and being further configured to receive a release authorization transmitted from the server in response to the release request; and the control system being further configured to release a packaged unit of securable media resident within the receptacle to circulation at least in part by switching the circulation control station from the first configuration to the second configuration, responsive to the release authorization.

19. The system of claim 18 wherein the electronic security control mechanism includes a first RFID reader/writer and the circulation control station further includes a second RFID reader/writer, wherein the control system further includes a card scanner and is further configured to transmit the release request responsive to media identification data from either of the first or second RFID reader/writer and responsive to user identification data from the card scanner.

20. The system of claim 19 wherein the first RFID reader/writer defines a first electronic control range, the second RFID reader/writer defines a second electronic control range, and the mechanical security control mechanism defines a magnetic control range, and wherein each of the first electronic control range and the magnetic control range is non-overlapping with the second electronic control range.

21. The system of claim 20 further comprising a packaged unit of securable media having an RF security tag and a magnetic lock, an electronic communication link between the first RFID reader/writer and the RF security tag, and a magnetic communication link between the mechanical security control mechanism and the magnetic lock.

* * * * *